US008404628B1

(12) United States Patent
May

(10) Patent No.: US 8,404,628 B1
(45) Date of Patent: Mar. 26, 2013

(54) METHOD FOR SPRAY BLEACHING CELLULOSIC FABRICS

(75) Inventor: Ruth E. May, Winston-Salem, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 13/444,388

(22) Filed: Apr. 11, 2012

Related U.S. Application Data

(63) Continuation-in-part of application No. 12/329,680, filed on Dec. 8, 2008, now abandoned.

(51) Int. Cl.

| | |
|---|---|
| ***C11D 3/39*** | (2006.01) |
| ***C11D 7/18*** | (2006.01) |
| ***C11D 9/20*** | (2006.01) |
| ***C01B 15/01*** | (2006.01) |

(52) U.S. Cl. ..... 510/309; 510/276; 510/302; 510/367; 510/375; 510/394; 252/186.25; 252/186.28; 252/186.29; 252/186.43

(58) Field of Classification Search ..... 252/186.25, 252/186.28, 186.29, 186.43; 510/276, 302, 510/309, 367, 375, 394
See application file for complete search history.

(56) References Cited

U.S. PATENT DOCUMENTS

| | | | | |
|---|---|---|---|---|
| 2,532,471 | A | | 12/1950 | Wedler |
| 2,915,230 | A | | 12/1959 | Brewin et al. |
| 2,974,838 | A | | 3/1961 | Parham |
| 2,985,502 | A | | 5/1961 | Kronsbein et al. |
| 2,990,087 | A | | 6/1961 | Brewin et al. |
| 2,990,088 | A | | 6/1961 | Isken et al. |
| 3,022,926 | A | | 2/1962 | Bailey, Jr. |
| 3,142,423 | A | | 7/1964 | Carter |
| 3,181,749 | A | | 5/1965 | Helliwell et al. |
| 3,357,611 | A | | 12/1967 | Berger et al. |
| 3,449,254 | A | | 6/1969 | Suiter |
| 3,468,539 | A | | 9/1969 | Swindall |
| 3,653,562 | A | | 4/1972 | Kronsbein |
| 3,957,428 | A | | 5/1976 | Massey et al. |
| 3,973,902 | A | | 8/1976 | Zimmermann et al. |
| 4,324,117 | A | | 4/1982 | Schwob et al. |
| 4,345,907 | A | | 8/1982 | Wegele et al. |
| 4,361,019 | A | | 11/1982 | Maund |
| 4,501,038 | A | | 2/1985 | Otting |
| 4,515,597 | A | * | 5/1985 | Guth et al. ..... 8/107 |
| 4,648,250 | A | | 3/1987 | Yabe |
| 4,676,078 | A | | 6/1987 | Ramsey |
| 4,717,391 | A | | 1/1988 | Daniel et al. |
| 4,793,014 | A | | 12/1988 | Luigi |
| 5,016,308 | A | | 5/1991 | McBride et al. |
| 5,040,475 | A | | 8/1991 | Fournier et al. |
| 5,205,305 | A | | 4/1993 | Yamakita |
| 5,458,265 | A | | 10/1995 | Hester et al. |
| 5,512,062 | A | | 4/1996 | Fuller et al. |
| 5,616,280 | A | * | 4/1997 | Moore et al. ..... 252/186.29 |
| 5,713,223 | A | | 2/1998 | Lin |
| 5,850,651 | A | | 12/1998 | Ishmaru et al. |
| 5,960,650 | A | | 10/1999 | Chi-Lung |
| 6,443,569 | B1 | | 9/2002 | Mheidle et al. |
| 6,610,641 | B2 | * | 8/2003 | Hage et al. ..... 510/375 |
| 6,740,126 | B2 | | 5/2004 | Wang et al. |
| 6,903,060 | B1 | * | 6/2005 | Dykstra et al. ..... 510/314 |
| 7,033,403 | B2 | | 4/2006 | Bentham |
| 7,585,829 | B1 | * | 9/2009 | Taylor ..... 510/380 |
| 2002/0183228 | A1 | * | 12/2002 | Bachmann et al. ..... 510/376 |
| 2003/0041387 | A1 | | 3/2003 | Xu et al. |
| 2003/0154556 | A1 | | 8/2003 | Del Duca et al. |
| 2003/0224960 | A1 | * | 12/2003 | Scialla et al. ..... 510/302 |
| 2006/0260074 | A1 | * | 11/2006 | May et al. ..... 8/636 |
| 2007/0199164 | A1 | * | 8/2007 | May et al. ..... 8/543 |
| 2008/0034508 | A1 | * | 2/2008 | Abbott et al. ..... 8/445 |
| 2008/0066878 | A1 | * | 3/2008 | Nguyen ..... 162/24 |
| 2009/0193596 | A1 | * | 8/2009 | May ..... 8/499 |
| 2010/0140545 | A1 | * | 6/2010 | May ..... 252/186.29 |
| 2011/0179588 | A1 | * | 7/2011 | May et al. ..... 8/499 |
| 2011/0179589 | A1 | * | 7/2011 | May ..... 8/543 |

OTHER PUBLICATIONS

"Spray Dyeing on Cotton and Wool Fabrics," International Dyer, Dyeing Cotton & Cellulosics, Jan. 2003, pp. 12-14.

* cited by examiner

*Primary Examiner* — Joseph D Anthony
(74) *Attorney, Agent, or Firm* — Womble Carlyle Sandridge & Rice LLP

(57) ABSTRACT

A method is provided for spray bleaching cellulosic fabrics. A bleaching composition comprises a wetter, hydrogen peroxide, a caustic, a stabilizer, an optical brightener, and water. The bleaching composition is sprayed on at least one surface of the cellulosic fabric, subjected to steam to fix the bleaching composition to the fabric, and rinsed to remove any residual bleaching composition.

32 Claims, No Drawings

METHOD FOR SPRAY BLEACHING CELLULOSIC FABRICS

RELATED APPLICATIONS

This is a continuation-in-part of application Ser. No. 12/329,680, filed Dec. 8, 2008 now abandoned, the contents of which are incorporated herein by reference in their entirety.

FIELD OF THE INVENTION

The invention relates generally to the bleaching of cellulosic greige fabrics, and, more particularly, to a method for uniformly spray bleaching both surfaces of a fabric, while at the same time reducing the amount of water consumption.

BACKGROUND OF THE INVENTION

Today, fabrics are made from a wide-variety of natural fibers, such as cotton, synthetic fibers, and combinations thereof. The basic fabric is a greige fabric that must be dyed or bleached in order to provide the desired whiteness and brightness to the resultant fabric and/or garment. In the case of knitted fabrics, the basic greige fabric is tubular, meaning that both inner and outer surfaces of the tube must be dyed or bleached.

There are numerous known methods for bleaching fabrics, including the use of continuous ranges and high temperature jets. Continuous range bleaching involves a multiple step process, including the application of an optical brightener to make the fabric look whiter following a fabric rinse and nip step. In some cases, this requires re-handling of the fabric, which adds to process time. The fabric must be handled again as it is moved to a pad machine for the application of a softener that improves the hand to the fabric, and then to a dryer. In high temperature jet bleaching, the bleaching chemicals are applied at higher temperatures than are obtained in a continuous range, and optical brighteners are exhausted onto the fabric. In this process, however, the size of the load of fabric in the jet vessel is limited, therefore increasing the time and labor required to load and unload smaller quantities of fabric. The fabric must then be moved to the pad machines for application of a softener. Thereafter, the fabric must be moved to the dryers.

A further disadvantage of conventional bleaching or dyeing, for example, in current jet vessels, is the relatively large amount of water required. In current jet vessels, the liquor ratio may be as high as 10:1. As used herein, the term "liquor ratio" means the quantity in pounds of water per pound of fabric used to perform the initial bleaching process. Thus, each pound of fabric to be bleached or dyed requires about 10 pounds (1.2 gallons) of water. In the conventional process, the bleaching or dyeing step must be followed by 3 to 4 consecutive rinses with water to free the fabric of residual hydrogen peroxide, sodium hydroxide, and other residuals found in cellulosic fabric (seeds, waxes, natural oils, knitting and spinning oils, etc.). In the case of a 10:1 ratio, this would require 30 to 40 pounds of water, or a total of about 50 pounds (6.0 gallons) of water to complete the bleaching and rinsing process for each pound of fabric.

Spray bleaching of fabric is also possible, although a disadvantage of spray bleaching is the lack of uniform bleaching on both sides of the fabric. Achieving such uniformity requires spraying both sides of the fabric or garment in a very controlled environment. Also, the fabric or garment must remain in a taut position in order to provide a flat and even distribution of the bleach formulation onto the fabric or garment, yet not have any area that is covered or unavailable for receipt of the spray.

What is needed, therefore, is a method for bleaching cellulosic, especially greige, fabrics that provide uniform scouring and/or bleaching on both the inner and outer sides of the fabric that minimizes the amount of water and chemicals used. Such a method would allow bleaching cotton to the desired whiteness in one basic spray step or operation and eliminate the need for a controlled environment and the problems noted above for positioning the fabric or garment, yet would provide good bleach penetration into the fabric or garment.

The above-described and other advantages and features of the present disclosure will be appreciated and understood by those skilled in the art from the following detailed description and appended claims.

DETAILED DESCRIPTION

Certain exemplary embodiments of the present invention are described below. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

One aspect of the present invention is directed to using formulations for spray bleaching cellulosic fabric. More particularly, the present invention relates to a method for uniformly spraying a bleach formulation on both surfaces or sides of a cotton fabric. In one embodiment, the formulation that is used comprises a wetter, hydrogen peroxide, a caustic, a stabilizer, an optical brightener, and water.

The wetter of the present compositions facilitates movement of the other constituents of the composition, particularly the hydrogen peroxide, i.e., the bleaching agent, into the fabric. The wetter is a blend of one or more surfactants, and, more particularly, a nonionic compound of surfactants that provides detergent cleansing properties and creates hydrophilicity in the fabric. One commercially available wetter is Ultravon® CN-US, available from Huntsman International LLC, in Salt Lake City, Utah.

The wetter comprises an amount between about 32 grams per liter (g/1) and about 64 g/l of the composition (3.2% to 6.4% by weight of the composition). In one embodiment, the wetter comprises about 40 g/l (4.0%).

As is well known in the art, hydrogen peroxide has strong oxidizing properties and is, therefore, an effective bleaching agent. The hydrogen peroxide is present in an amount of between about 80 g/l and 150 g/l (8.0% to 15% by weight of the composition). The amount of hydrogen peroxide is dependent upon the makeup of the greige fabric to be bleached. For example, some fabrics contain numerous cotton seeds, organic contaminants, relatively insoluble knitting oils, and minerals such as magnesium and calcium from the soil in which the cotton is grown. Certain fabrics also require cleaner and brighter fabric bases. The base whitening of the hydrogen peroxide, along with the alkali (caustic soda) in the composition, bleaches the cotton fiber to a white in preparation for the optical brighteners, which create the fluorescent brightness of white. In the embodiment described herein, the hydrogen peroxide comprises about 100 g/l (10.0%).

The caustic (50% soda) is selected from sodium hydroxide, sodium carbonate, or soda ash. The caustic soda increases the pH of the solution to between about 10.5 and 11.0, which is needed to activate and initiate the whitening action of the hydrogen peroxide. The high pH of the caustic also breaks down any organic compounds and dissolves the cotton seeds. The caustic comprises an amount between about 5 g/l and 90 g/l (0.50% to 9.0% by weight of the composition). In the embodiment described herein, the caustic is sodium hydroxide and comprises about 30 g/l (3.0%). This amount, however, is dependent upon the initial condition of the fabric being treated.

The stabilizer may be an organophosphorus compound, which is the primary constituent for providing chemical stability to the total composition. A stabilizer is an integral part of the composition due to the volatile oxidation properties of the hydrogen peroxide, which creates heat when mixed with the alkali and water. Since the composition has all of the necessary components to bleach and whiten fabric, the stabilizer also helps to keep the optical brightener from precipitating out of the solution. The organophosphorus compound comprises an amount between about 5 g/l and 50 g/l (0.5% to 5.0% by weight of the composition). In one embodiment, the organophosphorus compound comprises about 20 g/l (2.0%). One suitable stabilizer is Tinoclarite® CBB, also commercially available from Ciba Specialty Chemicals in High Point, N.C.

The optical brightener, or optical brightening agent (OBA), is provided to absorb light in the ultraviolet and violet regions (usually 340-370 nm) of the electromagnetic spectrum. The optical brightener may be a distyryl biphenyl compound comprising an amount between about 0.1 g/l and 1.0 g/l (0.01% to 0.10% by weight of the composition). In the embodiments described herein, the optical brightener comprises about 0.2 g/l (0.02%). One suitable optical brightener is Unitex® NFW, also commercially available from Ciba Specialty Chemicals in High Point, N.C. This optical brightener should be able to withstand the high pH conditions of the composition described herein, as high pH conditions are detrimental to some optical brighteners.

Optionally, and depending upon the quality of the water supply, a chelator, which is a softener, may be added to the composition. The chelator is used to remove hard metals from the water, and prevents precipitation that leads to unevenness in the whiteness of the fabric. It may also assist in stabilizing the composition. Thus, a chelator may not be needed in the composition if minerals, such as hard metals, are not present in the fabric itself or in the water source. Chelators that may be used in the present composition include, but are not limited to, a blend of amino acid derivatives or pentasodium salt of diethlentriaminepenta acetic acid. If needed, the chelator comprises an amount between about 1 g/l and 20 g/l.

Also, optionally, an alkali, such as sodium silicate, may be added to the composition, depending upon the quality of the greige fabric, to further assist in bleaching the fabric. If needed, the sodium silicate comprises an amount between about 10 g/l and 90 g/l. Sodium silicate also may be used in the composition as a stabilizer for the oxidation of the hydrogen peroxide and caustic soda.

Thus, the basic composition comprising the wetter, hydrogen peroxide, caustic, stabilizer, and optical brightener comprise between 12.2% and 35.5% by weight of the total composition, with an optimal amount of about 19.0%. Therefore, the composition of the present invention comprises between about 64.4 and 87.8% by weight of water, with an optimal amount of about 81%.

Turning now to the method of applying the composition of the present invention, all of the ingredients may be mixed simultaneously, preferably in an in-line, spray head. For example, each ingredient is transported to a sleeve or manifold having a mixer, such as a corkscrew therein, to mix together all of the constituents of the composition before they enter the spray head.

Following mixing, the composition is sprayed on the surfaces or sides of a fabric using one or more spray nozzles. The manifold and spray nozzles may be fixed in position as the fabric is moved beneath or above them in a machine direction. In one embodiment, the fabric is moved at a rate of between about 20 and 80 yards per minute in the machine direction with respect to the nozzles. In one embodiment of the method, about 40 yards per minute provides sufficient penetration of the fibers. The rate is dependent upon the saturation needed to penetrate the fibers. In this embodiment, the average weight of the 40 yards of fabric is approximately 20 pounds, or about 0.5 pounds per yard of fabric. Alternatively, the spray nozzles may be movable with respect to each surface or side of the fabric so that a substantially even coat of the composition is applied to the surfaces of fabric. One method of spray dyeing, which also has applicability to spray bleaching, is disclosed in U.S. Pat. No. 7,033,403, which is incorporated herein by reference in its entirety. In the case of a tubular knitted fabric, spray nozzles may be positioned above and below the fabric to ensure penetration through the entire fabric tube.

Saturation may be measured in terms of wet pickup calculations. The percentage of wet pickup is dependent upon the saturation and absorption of the fabric. Wet pickup is calculated after the composite solution is sprayed onto the fabric and a wet piece of the fabric is weighed. The piece is then rinsed with continuously running water, removing all of the sprayed composition. The fabric piece is then dried and weighed again. The weight of the sprayed piece minus the dry weight, divided by the weight of the sprayed fabric, yields the wet pickup. A wet pickup of between about 60 percent and 80 percent has been found to be optimal. This equates to between about 0.1 and 0.3 gallons per minute of composition applied to the fabric.

It should be recognized that the present invention contemplates any number of spray nozzles and numerous nozzle orientations. Also, the size of the head of a spray nozzle may vary.

As will be appreciated, following spray application of the composition onto the fabric, the treated fabric may be then subjected to heat (steam) to fix the chemicals to the fabric. In one embodiment, this may be performed at between about 180 and 190 degrees Fahrenheit for about 3 minutes. The fabric is then rinsed with sprayed water. In one embodiment of the method, the fabric is rinsed with about 6 gallons of sprayed water per minute. Thereafter, the fabric is routed through squeeze rollers to extract about 85 percent of the water, and dried using conventional drying equipment. The savings in the amount of water is thus due to the lack of having to submerse the fabric in a bath (jet vessel), wherein between 30 and 50 pounds of water would be required for the total process per pound of fabric.

The following example is exemplary of water savings using the composition and method of the present invention:

In an exemplary embodiment, the machine is moving the fabric at a rate of about 40 yards per minute (20 pounds of cotton fabric) and spraying the composition on the greige fabric at between 0.1 and 0.3 gallons per minute. As described above, assuming 81% by weight of water, this equates to between about 0.081 and 0.243 gallons of water. At a weight of 8.345 pounds per gallon, the weight of water used in the application of the composition is between about 0.68 and 2.03 pounds of water for the 20 pounds of cotton fabric, or a liquor ratio of between about 0.03:1 and 0.09:1. The rinsing step of the method requires approximately 6 gallons of water for 20 pounds of fabric, or about 2.5 pounds of water per pound of fabric. Thus, the total liquor ratio for water used for the entire process is between about 2.53:1 and 2.59:1. As will be appreciated by this example, this is a significant savings in terms of water required, as compared to between 30 and 50 pounds of water for 20 pounds of fabric required in the conventional process.

Thus, the present method does not require the use of a controlled environment and allows for the bleaching of all cellulosic fabrics, particularly greige, and facilitates manufacturing flexibility in that rapid changeovers from a bleach composition to a dye composition, and vice versa on the same spray application machine are possible.

With respect to the whiteness of the fabric, it has been found that application of the composition in a single mixture results in a whiteness value of at least between about 125 and 135, which is the industry standard for whiteness, as measured with an X-Rite spectrophotometer.

Another benefit achieved by the present method of spray bleaching cellulosic fabrics is that one can effectively and efficiently bleach long continuous runs of fabric with the compositions described herein, significantly reducing the time and labor required by known bleaching methods.

The invention has been described herein in terms of embodiments that are considered by the inventor to represent the best mode of carrying out the invention. It will be understood by those skilled in the art that various modifications, variations, changes and additions can be made without departing from the spirit and scope of the invention. These and other modifications are possible and within the scope of the invention as set forth in the claims.

I claim:

1. A method for spray bleaching cellulosic fabrics, comprising:

(a) mixing together a wetter, hydrogen peroxide, a caustic, a stabilizer, an optical brightener, and water to form a bleaching composition wherein the weight percent of water is selected to produce in a single spray operation a whiteness on the cellulosic fabric of at least 125 when measured with an X-Rite spectrophotometer (b) spraying the bleaching composition on at least one surface of the cellulosic fabric;

(c) subjecting the fabric to heat to fix the bleaching composition to the fabric; and (d) rinsing the bleached fabric to remove any residual bleaching composition.

2. The method of claim 1, wherein the wetter comprises a surfactant.

3. The method of claim 2, wherein the surfactant comprises between about 32 g/l and 64 g/l of the bleaching composition.

4. The method of claim 1-wherein the hydrogen peroxide comprises between about 80 g/l and 150 g/l of the bleaching composition.

5. The method of claim 1, wherein the caustic is sodium hydroxide.

6. The method of claim 5, wherein the sodium hydroxide comprises between about 5 g/l and 90 g/l of the composition.

7. The method of claim 1, wherein the stabilizer is an organophosphorus compound.

8. The method of claim 7, wherein the organophosphorus compound comprises between about 5 g/l and 50 g/l of the composition.

9. The method of claim 1, wherein the optical brightener is a distyryl biphenyl compound.

10. The method of claim 9, wherein the distyryl biphenyl compound comprises between about 0.1 g/l and 1 g/l of the composition.

11. The method of claim 1 wherein the water comprises between about 64 and 81 percent by weight of the bleaching composition.

12. The method of claim 1, wherein the bleaching composition further comprises a chelator.

13. The method of claim 12, wherein the chelator is a softener.

14. The method of claim 1, wherein the bleaching composition further comprises a silicate.

15. The method of claim 14, wherein the silicate is sodium silicate.

16. The method of claim 15, wherein the sodium silicate comprises between about 10 g/l and 90 g/l of the composition.

17. The method of claim 1, wherein the wetter, hydrogen peroxide, caustic, stabilizer, optical brightener, and water are mixed together simultaneously before entering the spray head.

18. The method of claim 17, wherein the components are mixed together in a manifold having a corkscrew mixer therein.

19. The method of claim 1, wherein the cellulosic fabric is a knitted tubular fabric.

20. The method of claim 1, wherein the composition is sprayed with nozzles above and beneath the tubular fabric.

21. The method of claim 1, further comprising moving the cellulosic fabric at a rate between about 20 and 80 yards per minute with respect to the spray nozzles.

22. The method of claim 21, wherein the cellulosic fabric is moved at a rate of about 40 yards per minute.

23. The method of claim 22, wherein the fabric weighs between about 0.5 pounds per yard.

24. The method of claim 1 wherein the bleaching composition is sprayed on the cellulosic fabric at a rate of at least 0.1 gallons per minute.

25. The method of claim 24 wherein the bleaching composition is sprayed on the cellulosic fabric at a rate of between 0.1 and 0.3 gallons per minute.

26. The method of claim 25, wherein the cellulosic fabric has a wet pickup of at least 60 percent.

27. The method of claim 26, wherein the wet pickup is between 60 percent and 80 percent.

28. The method of claim 1, wherein a liquor ratio of water to fabric of the bleaching composition is between about 0.03:1 and 0.09:1.

29. The method of claim 1, wherein the sprayed fabric is subjected to heat at atmospheric pressure of between about 180 and 190 degrees Fahrenheit.

30. The method of claim 1, wherein a liquor ratio of water used in rinsing the fabric is about 2.5:1.

31. The method of claim 1, wherein a total liquor ratio of water used in the method for spray application and rinsing is between about 2.53:1 and 2.59:1.

32. The method of claim 1, wherein the bleaching composition produces a whiteness on the cellulosic fabric of between about 125 and 135 when measured with an X-Rite spectrophotometer.

* * * * *